US005524996A

United States Patent [19]

Carpenter et al.

[11] Patent Number: 5,524,996

[45] Date of Patent: Jun. 11, 1996

[54] LINERLESS LABEL PRINTING APPARATUS

[75] Inventors: George F. Carpenter, Rockford; Karl Burdick, Comstock Park, both of Mich.

[73] Assignee: Grand Rapids Label Company, Grand Rapids, Mich.

[21] Appl. No.: 343,634

[22] Filed: Nov. 22, 1994

[51] Int. Cl.[6] ..... B41J 11/70

[52] U.S. Cl. ..... 400/621; 400/583; 101/288

[58] Field of Search ..... 101/288, 224, 101/226, 227; 400/621, 593, 633, 582, 583; 156/56, 344, 354

[56] References Cited

U.S. PATENT DOCUMENTS

| | | | |
|---|---|---|---|
| 3,190,519 | 6/1965 | Nash | 101/288 |
| 4,560,990 | 12/1985 | Sue et al. | 400/621 X |
| 4,707,211 | 11/1987 | Shibata | 156/354 |
| 4,784,714 | 11/1988 | Shibata | 156/354 |
| 5,040,461 | 8/1991 | Van-Ocker | 101/288 |
| 5,099,290 | 3/1992 | Yokota | 101/228 |
| 5,188,470 | 2/1993 | Matsubara et al. | 400/621 |
| 5,375,752 | 12/1994 | Michalovic | 225/2 |
| 5,378,301 | 1/1995 | Boreali et al. | 156/344 |
| 5,417,783 | 5/1995 | Boreali et al. | 156/56 |

*Primary Examiner*- Christopher A. Bennett
*Attorney, Agent, or Firm*- Varnum, Riddering, Schmidt & Howlett

[57] ABSTRACT

A label printer apparatus is arranged to produce printed labels from a continuing strip of adhesive-backed, linerless label material. By operation of a standard printer roller, the apparatus advances a strip of linerless material along a path from a roll of the material over a print head where a portion of the strip is printed. The printed portion is advanced past a cutting blade onto a label applicator and is severed from the remainder of the strip by operation of a cutting blade. A guide comprising a lower wall and a pair of opposing side walls is disposed along the path and serves as a guide for the adhesive back material from the roll to the printer. The printer roller is controlled by a control unit responsive to operator input instructions and the condition of a photosensor to position and reposition the leading edge of the strip relative to the print head, before and after printing operation.

12 Claims, 4 Drawing Sheets

LINERLESS LABEL PRINTING APPARATUS

BACKGROUND OF THE INVENTION

1. Field of the Invention

This invention relates to label printing devices and more particularly to a label printing device for printing and dispensing labels.

2. Background Art

Label applicator apparatus for applying preprinted labels to packages, envelopes, and the like typically include a print head and a supply of blank labels attached to a label backing supplied in the form of a roll. The label backing and labels are typically advanced past a print head for address printing, bar code printing or the like. After advancing beyond the print head, the labels are typically separated from the backing by advancing the label backing over a label separator bar while the label itself is advanced to a label applicator mechanism. To produce a supply of labels on a label backing, a backing sheet is first prepared with a coating of low adhesive properties. The backing sheet is then coated with an adhesive and joined to a label sheet printed on one side with a plurality of label outlines. The backing sheet is provided with the coating of low adhesive properties to allow the subsequently added adhesive to adhere to the labels rather than to the backing when the labels are removed from the backing. The label sheet and backing are typically passed through a machine which, by means of a cutting die, cuts the label sheet adjacent the label outlines and removes all label sheet material from between label outlines to produce a backing sheet with a plurality of labels ready to be printed. Expensive special equipment is required to produce a supply of labels on a backing sheet, adding significantly to the cost of labels. Furthermore, waste from the label producing operation and the backing sheet must be properly disposed of, further adding to the cost of the label producing process. It is therefore desirable to create labels from a strip of adhesive-backed label material without first forming the labels on a label backing sheet.

A primary reason for placing adhesively backed labels on a strip of backing material is to facilitate the handling and printing of the labels. Labels are typically printed by advancing a strip of the backing material with the attached label over a print head. After the label has been printed, it is separated from the backing material and applied to an object to be labelled. In order to create labels from a strip of adhesive-backed label material, without the benefit of a label backing, the adhesive label material must be advanced through a label printing machine and must be cut and deposited on a label applicator, which transfers the label to an object to be labeled. In conventional label printing and application apparatus, the backing material is drawn past the print head and transporting a label beyond the print head to a label applicator. Therefore, several technical problems are to be solved when labels are created directly from an adhesive-backed strip. A primary problem is the advancing of the label material past the print head and to an applicator without the benefit of a label backing strip which commonly acts as a vehicle for transporting the label past the print head and to the applicator. A further problem is to transport, cut and print pressure-sensitive, adhesive-backed label material while preventing the adhesive material from sticking to the apparatus, thereby causing the apparatus to malfunction.

SUMMARY OF INVENTION

These and other problems of the prior art are overcome in accordance with the present invention by providing a method and apparatus for producing printed labels from a continuous, linerless strip of adhesive label material. The method includes advancing the adhesive-backed strip of material over a standard print head and cutting labels of desired size from the strip of label material after the label has been printed.

In one embodiment of the invention, the apparatus for producing printed labels from linerless label material comprises a print head and label cutter apparatus as well as a printer roller which advances a strip of linerless label material over the print head and past the cutter apparatus. A controller controls the print head to print a selected portion of the strip, controls the printer roller to advance the printed portion past the cutter apparatus and controls the cutter apparatus to cut the printed portion from the strip of linerless material. Further, the apparatus in accordance with the invention includes an upper plate disposed adjacent the printer roller and having opposing end walls and a spatial area between the end walls. The upper plate advantageously serves to guide the strip of linerless label material with minimal contact with the adhesive side of this strip.

In one particular embodiment of the invention, the apparatus comprises a guide having a lower wall extending in a plane substantially parallel to the path of the strip of linerless material and having opposing side walls spaced apart by a distance greater than the width of the strip of linerless label material to serve as a guide for the strip.

In accordance with one aspect of the invention, the apparatus includes an air tube comprising a plurality of orifices applying a force to assist in directing the strip from the print head to the cutter apparatus. In accordance with one particular embodiment of the invention, a second air pressure tube is provided which applies a guiding force to a portion of the strip of label material extending past the cutter apparatus. The cutter apparatus, in accordance with one embodiment of the invention, comprises a vertically extending cutting blade having a vertical cutting edge and a horizontally extending cutting blade having a horizontal cutting edge and an actuator operative to actuate one of the cutting blades past the other, to cut a selected portion from the strip of linerless label material. In accordance with one particular aspect of the invention, a photodetector is provided which generates detector output signal indicative of the presence of the label material at a specific location.

In accordance with one aspect of the invention, the method of producing printed labels from a strip of linerless label material comprises positioning a portion of the strip adjacent the print head, printing the selected portion, advancing the strip to a position wherein the selected portion is adjacent a label applicator and then cutting the selected portion from the strip. Thereafter, the strip may be withdrawn to a position wherein another selected area is disposed adjacent the print head and an additional portion of the strip is printed. In accordance with one particular aspect of the invention, the strip is advanced by a predetermined distance after a first selected portion has been printed and immediately thereafter a second selected portion is printed. Thereafter, the strip is advanced further to a cutting position in which the first selected portion is severed from the strip and, thereafter, the strip is withdrawn to a position in which a third portion is printed. Thereafter, the strip is again advanced to a position in which the second selected portion is severed from the strip. Advantageously, in this manner, the distances of advancement and withdrawal are reduced to allow for a faster printing operation.

BRIEF DESCRIPTION OF THE DRAWINGS

An embodiment of the invention is disclosed in which.

DETAILED DESCRIPTION

Figure 1:
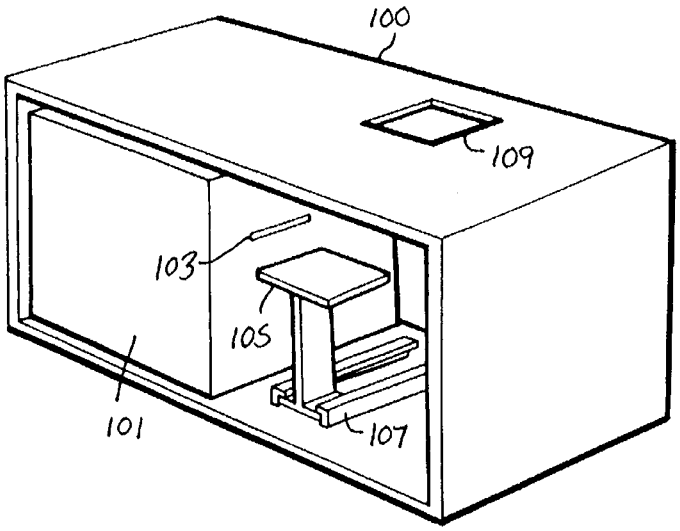
Fig. 1 prior art
FIG. 1 depicts prior art label printing and applicator apparatus.

FIG. 1 shows a prior art label applicator 100 including a label printer housing 101 in which pre-cut labels on a label backing are advanced past a print head and printed labels are separated from the label backing and advanced through the opening 103. The printed label is deposited on a known label transport 105 which is moved laterally in a track 107 between a position in alignment with opening 103 to a position in alignment with a window 109. When the label is deposited on the label carrier, it is held in place by a low vacuum carrier, applied to the label through the carrier. When the label is to be transferred to an envelope or the like, the head of the label transport is moved upwardly by an air cylinder (not shown in the drawing) to transfer the label through the window 109 and onto an object to be labeled.

Figure 2:
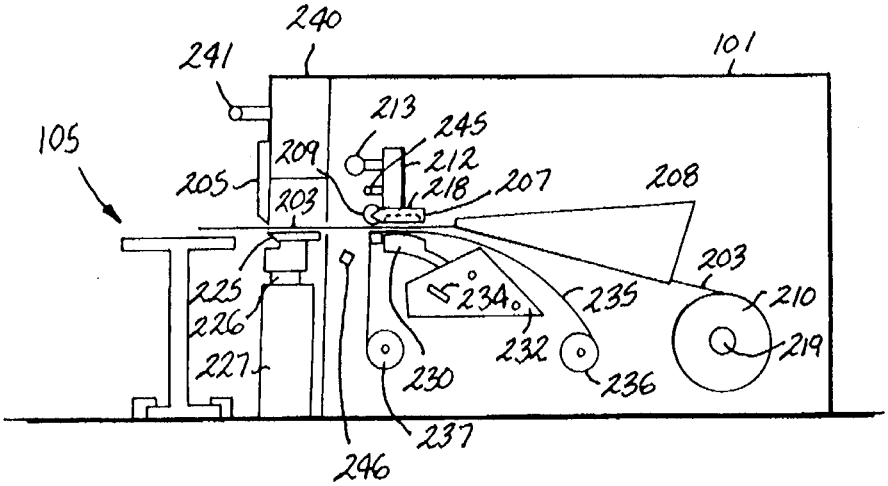
FIG. 2 is a side view of label tab printing and applicator apparatus incorporating aspects of the invention.

FIG. 2 is a side view of label applicator apparatus incorporating the principles of the invention. The apparatus of FIG. 2 includes a standard print head 201 of the type which is well know in the art. Such prior art print heads are preferably controlled by means of a system controller (not shown in FIG. 2), such as a micro computer or similar control arrangement, to print information specified by an operator, in a well known manner. A strip of linerless label material 203 is dispensed from a roll of material 210 and is advanced through a label strip guide 208. The linerless label material has an adhesive side and a non-adhesive side. The non-adhesive side of the strip of material 203 is adjacent the print head and the adhesive side is adjacent a top plate 207. The strip 203 extends between a printer roller 209 and print head 201 and is advanced from the roll 210 past the print head 201, by operation of the roller 209.

The printer roller 209 is preferably driven by a stepper motor operated under control of the system's controller, internal to the housing 101. The printer roller 209 is operated during the printing operation to advance the strip of label material over the print head 201 to allow a plurality of lines of print to be formed on a section of the label material. After the printing operation, the printer roller 209 is operated to advance the leading edge of the strip 203 in the direction of the label transport 105. Thereafter, the printed portion of the strip is cut from the remaining of the strip to form a printed label. The cutting operation is accomplished by means of a movable lower cutting blade 225 which is actuated in the vertical direction to force the label material 203 past a vertically extending, stationary upper cutting blade 205.

The print head 201 is mounted on an arm 230 supported on a pivotable bracket 232. A latch 234 locks the bracket in an operational position. The bracket 232 may be pivoted downwardly for access to the print head 201. The print head 201 may be anyone of a number of different types of print heads such as a thermal transfer print head, a dot matrix print head, etc. of types commonly used in label printing operations. A carbon impregnated ribbon 235 is used in thermal transfer and other printing operations. It extends from a supply reel 236 over the print head 201, between the print head 201 and the strip 203, to a take-up reel 237. The take-up reel 237 is a driven reel which is operated in synchronism with the printer roller 209, to advance the ribbon past the print head concomitantly with the advancement of the strip 203.

Figure 3:
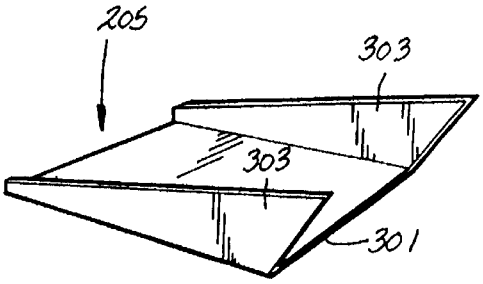
FIG. 3 is a perspective view of a label strip guide of FIG. 2.

The label strip guide 208 for guiding the label strip 203 is shown in perspective in FIG. 3. The guide comprises a substantially flat lower wall 302 and a pair of sidewalls 303 extending substantially perpendicularly to the lower wall 302. The width of the guide is slightly greater than the width of the strip of linerless label material 203. The guide 208 guides the strip 203 from a roll 210 of the linerless label material, rotably supported on a spindle 219 toward the print head 201. The strip 203 is preferably loosely supported in the guide 208, which also serves to control the manner in which the strip 203 is unwound from the reel 210 and to prevent the adhesive strip from doubling up on its adhesive side, causing possible apparatus malfunction.

Figure 4:
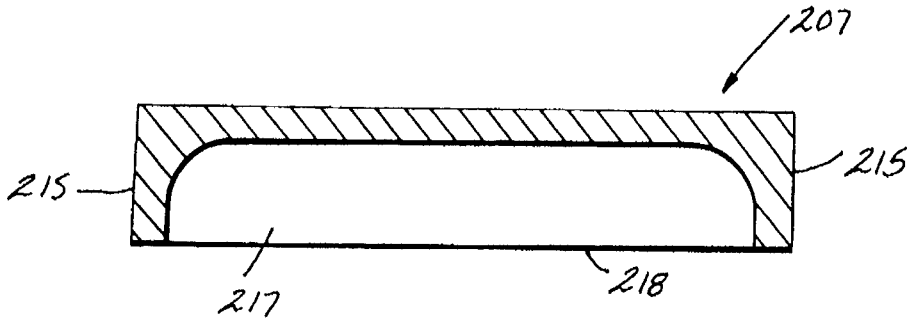
FIG. 4 is a cross-section view of a top plate of FIG. 2.

FIG. 4 is a cross-sectional view of the upper plate 207. As shown in FIG. 2, the upper plate forms a support for a bracket 212 which supports an air pressure tube 213 and a photodetector light source 245. The printer roller 209 is also supported on upper plate 207. The air pressure tube 213 is adapted to provide forced air to the strip of label material exiting from the area of the print head, as will be described further later herein. The upper plate 207 also serves as a guide for the label material directing the material toward the print head 201 and the roller 209. The upper plate 207 has a pair of end walls 215 and a pair of side walls 218 defining an inner-spacial area 217. The end walls 215 serve as a guide surface for the adhesive-backed strip 203. The spacial area between the end walls is provided to avoid a large area of contact with the adhesive-backed material in order to reduce the probability of the adhesive materials sticking to the upper plate.

Figure 5:
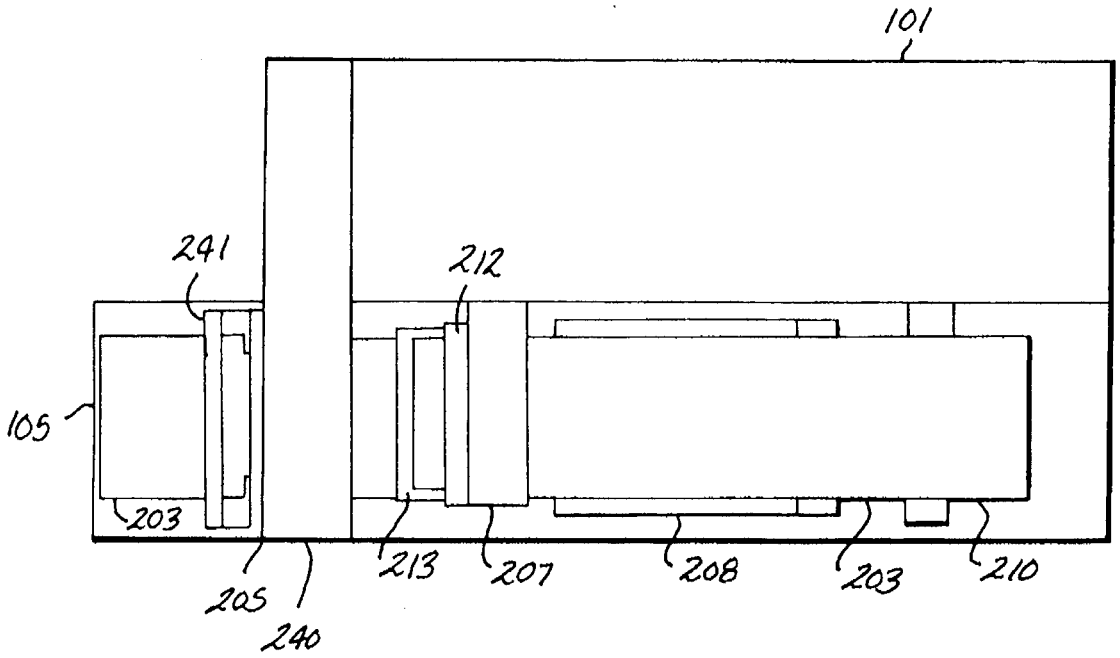
FIG. 5 is a top view of label printing and applicator apparatus shown in FIG. 2.

Referring to FIGS. 2 and 5, the bracket 212 is shown supported on upper plate 207. The air pressure tube, supported on bracket 212, is provided with openings (not shown in the drawing) directed downwardly toward the strip of linerless label material disposed between the printer roller 209 and the lower cutting blade 225. As the linerless label material 203 emerges from between the print head 201 and the printer roller 209, it has a tendency to adhere to the roller 209 and to turn in an upward direction. By means of air pressure tube 213, compressed air is forced against the upwardly directed strip to direct this strip downwardly as the strip is advanced toward the cutting blade 225. The air pressure within the air pressure tube 213 is preferably adjusted such that the strip 203 is essentially horizontal when it reaches the cutting blade 225. The air is preferably directed from the tube 213 to the strip of linerless label material to force the end portion of the strip downwardly and into the direction of the lower cutting blade 225.

The lower cutting blade 225 is supported on a piston 226 extending from a cylinder 227. The cylinder 227 may be an air-operated cylinder which forces the lower cutting blade 225 upperwardly and past the lower edge of the stationary upper cutting blade 205 to sever a section of printed label material from the remainder of the strip 203, thereby forming a label. The end portion of the strip 203 forming the label will be disposed on the carrier 105 and maintained on the carrier by a vacuum, in a standard fashion. The cylinder 227 is preferably an air-operated cylinder provided with a return spring in which the piston and the cutting blade 225 are actuated to the cutting position by application of air pressure and returned by the force of a return spring.

Figure 8:
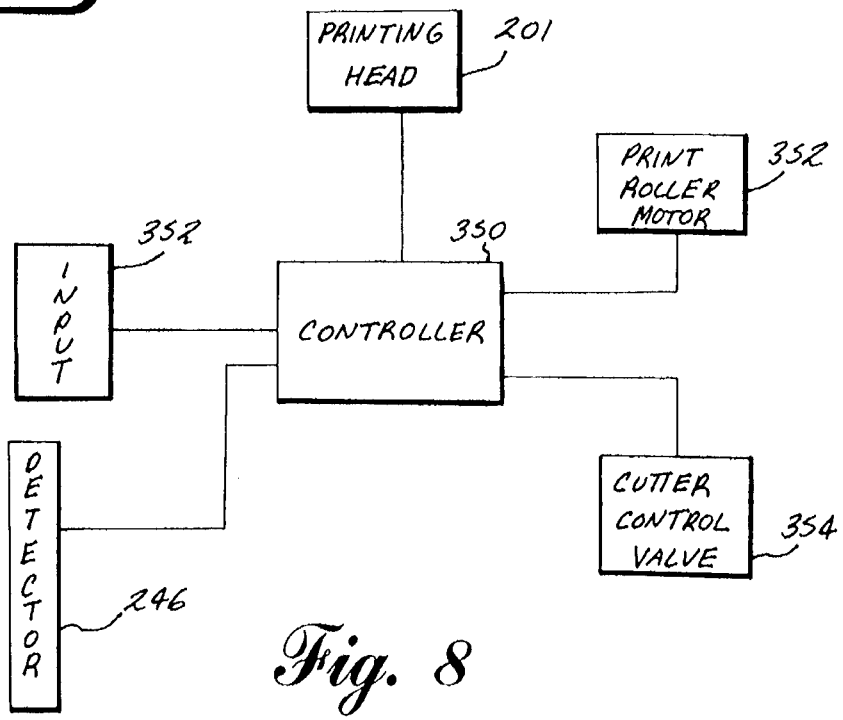
FIG. 8 is a block diagram representation of control apparatus in accordance with the invention.

The stationary upper cutting blade 205 is supported on a bracket 240 attached to the housing 101. Further supported on bracket 240 is a second air tube 241 similar to the tube 213 and provided with openings to direct forced air primarily downwardly, thereby providing pressure on the strip 203 in the direction of the carrier 105. The tube 241 may not be needed in all applications. Additionally, a relatively high vacuum may be applied to the carrier 105 thereby providing a force to maintain the end portion of the strip 203 in position on the carrier 105 during the cutting operation. The vacuum may be applied to the carrier 105 in a standard fashion by means of vacuum passages internal to the carrier. The cylinder 227 which actuates the lower cutting blade 225 is operated by a cutter control valve (not shown in FIG. 2). FIG. 8 is a block diagram representation showing a system controller 350 having an output connected to cutter control valve 354 as well as to print head 201 and a printer roller motor 352 which controls operation of the printer roller 209. The controller 350 is responsive to signals from an operator input device 352 as well as detector 246 to control the operation of print head 201, printer roller 352, and cutter control valve 354 at appropriate times.

It will be understood, that in the normal sequence of operation a leading edge portion of the strip 203 will be manually inserted between the print head 201 and the printer roller 209. The printer roller will be operated to advance the strip to a proper position for printing and subsequently will advance the strip to a cutting position. In a preferred sequence of operation, the control unit 350, which is a standard device in commercially available label printers, will be programmed to perform a homing function. To assist in the performance of that function, a sensor comprising a light source 245 and a detector 246 (FIG. 2) are employed.

Figure 6:
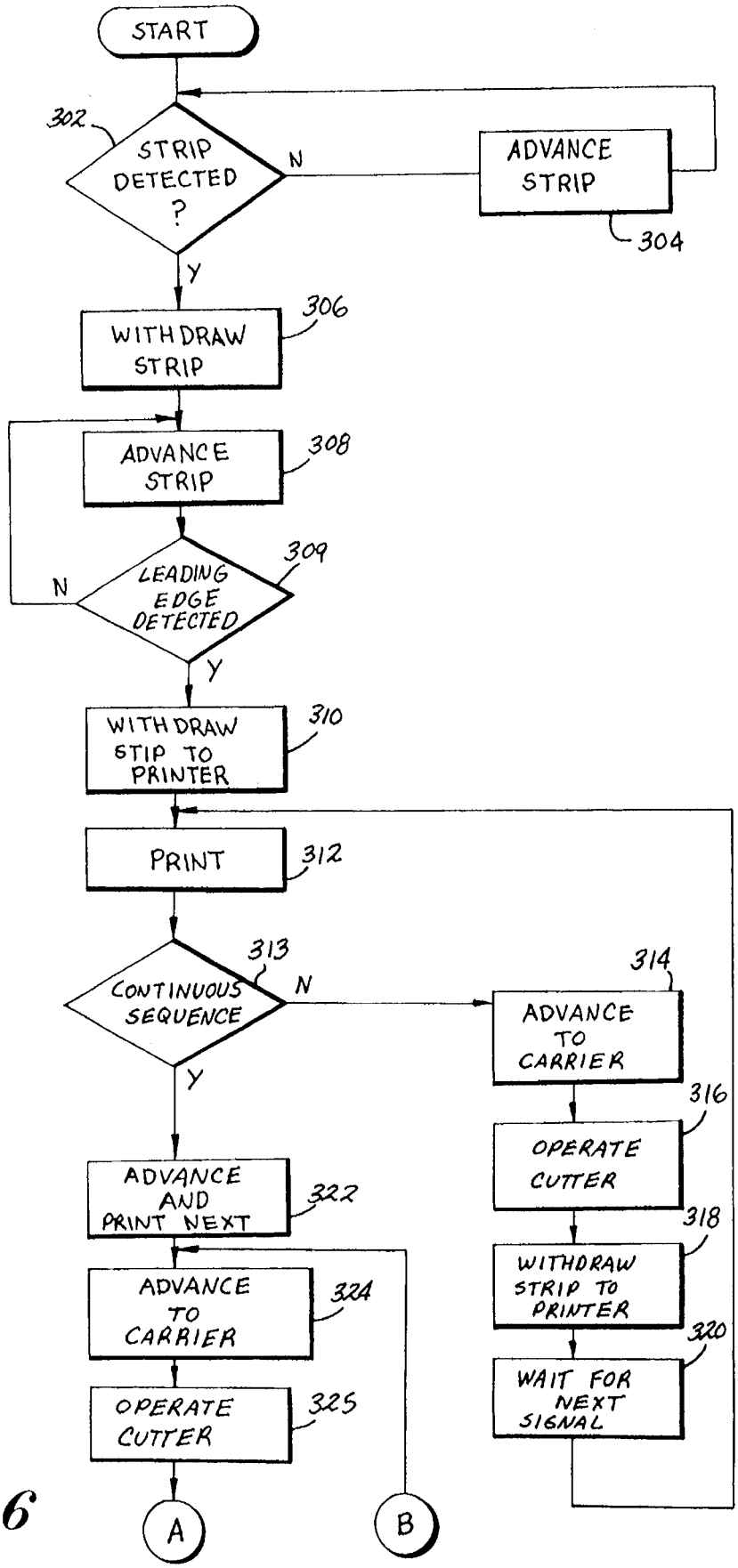
FIGS. 6 and 7 together form a sequence diagram of functions performed by label printing and applicator apparatus in accordance with the invention.
Figure 7:
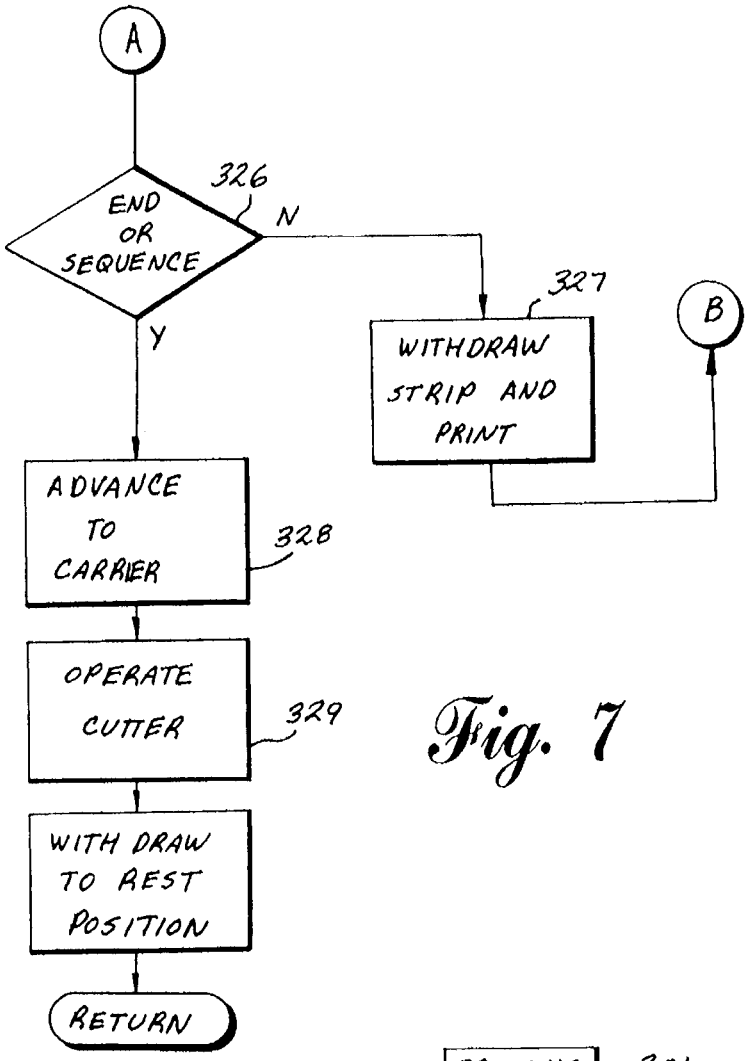

FIGS. 6 and 7 form a flow chart representation in which the sequence of advancing the strip, printing the strip, and cutting the strip are depicted. When the sequence is started, a test is made to determine whether the strip is advanced to the point where it is positioned between the light source 245 and the detector 246, as depicted in decision block 302. If the strip is not detected, it is advanced by operation of the roller 209. When the presence of the strip is detected at detector 246, the strip is again withdrawn a indicated in block 306 and subsequently advanced until the position of the leading edge of the strip is determined by means of the sensor 246. This function is indicated in blocks 308 and 309. After the position of the leading edge has been established, the strip is withdrawn such that the leading edge is a predefined distance from an edge of the print head, as indicated in block 310. The exact position of the leading edge with respect to the print head is a function of the width of the edge portion, after printing, of the label to be formed. As indicated in block 312, after the strip is properly positioned it is printed with the desired label information. Thereafter, a test is made, as indicated in decision block 313 to determine whether this is a continuous sequence or whether one label is being printed at a time. If it is not a continuous sequence, the leading edge of the strip 203 is advanced to the carrier and to the cutting position, as indicated in block 314. Thereafter, as indicated in block 316, the cutter is operated to sever the leading portion of this strip 203 from the remainder of the strip. The strip is then again withdrawn such that its leading edge is aligned with the print head for a subsequent printing operation as indicated in block 318. As indicated in block 320, operation is then stopped until a next signal is received indicating that a next label is to be printed. When that occurs, the printer is again operated as is indicated in block 312 and the sequence of blocks 313, 314, 316, 318 and 320 is again repeated.

If the test in block 313 indicates that this is a continuous sequence, the leading edge of the strip is advanced a predefined distance such that the area of the strip designated for the next label is in alignment with the print head and the next label section is printed, as indicated in block 322. After the second label has been printed, the leading edge of the strip 203 is advanced to the carrier such that the first printed label is in the cutting position, as indicated in block 324. As indicated in block 325, the cutter is then operated to sever the designated label from the strip. Thereafter, a test is made whether the end of a continuous sequence has been encountered as indicated in block 326. If it is not the end of the sequence, the strip 203 is again withdrawn by a distance such that a portion of the strip designated to be a third label is in alignment with the print head and the label is then printed, as indicated in block 327. Thereafter, the strip is again advanced such that its leading portion is aligned with the carrier and the steps indicated in blocks 324 through 327 are repeated until an end of sequence signal is encountered in the test of block 326.

When an end of sequence is encountered in the test of block 326, one printed label has been formed and deposited on the carrier and a next portion of the strip has already been printed and is ready to be severed from the strip to form the next label. Thus, in the event of an end of sequence, the next section designated to be the next label is advanced to the carrier as indicated in block 328 and the cutter is again operated as indicated in block 329. Thereafter, the label strip is withdrawn to a rest position which is preferably such that the leading edge of the strip 203 is positioned approximately midway between the printer roller 209 and the cutting label 225. It has been noted that with the strip 203 in the rest position, there is a tendency for the adhesive side of the strip to adhere to the roller 209. By advancing the leading edge of the strip some distance beyond the roller 209, the tendency for the end of the strip to turn upwardly is reduced. Furthermore, air pressure from the tube 213 against the leading portion of the strip 203 will tend to separate the strip from the roller 209 when the roller is again operated.

The sequence of operation of the carrier 105 is well known and is not further discussed herein. It will be apparent that the sequence of operation described above with respect to FIGS. 6 and 7 must be coordinated with the operation of the carrier 105 to assure that the strip 203 is advanced to the cutting position only when the carrier 105 is in its proper label accepting position.

It will be understood that the above-described arrangement is merely illustrative of the application of the principles of the invention and that other arrangements may be devised by those skilled in the art without departing from the scope of the invention as defined by the appendant claims.

What is claimed is:

1. Apparatus for producing printed labels from linerless label material comprising:

a predefined path and a strip of linerless label material extending along the predefined path;

a print head disposed along the path and along one side of the path;

a printer roller disposed adjacent the print head and along an other side of the path;

label cutter apparatus disposed along the path and spaced apart from the print head and having one side adjacent the print head having an opposite side;

a controller operative to control the print head to print a first selected portion of the strip of linerless label material disposed adjacent the print head and to control the printer roller to advance the first selected portion a predetermined distance in the path and to a position between the print head and the label cutter apparatus and to control the print head to print a second selected portion of the strip, the controller further operative to control the printer roller to advance the first selected portion to a position on the opposite side of the label cutter apparatus and to control the cutter apparatus to cut the first selected portion from the strip of linerless material and operative to activate the printer roller to withdraw the strip by a predetermined distance, to activate the print head to print a third selected portion and to subsequently activate the printer roller to advance the second selected portion to a position on the opposite side of the label cutter apparatus for cutting the second selected area while the third selected portion is disposed between the print head and the cutter apparatus; whereby a selected portion of the strip is printed before a previously printed portion is cut from the strip.

2. The label applicator apparatus in accordance with claim 1 wherein the cutter apparatus comprises a vertically extending cutting blade disposed on the adhesive side of the strip of linerless material and having a vertical cutting edge and a horizontally extending cutting blade disposed on the non-adhesive side of the strip of linerless material and having a horizontal cutting edge and an actuator operative to actuate one of the cutting blades past the other of the cutting blades to cut the selected portion from the strip of linerless label material.

3. The applicator apparatus in accordance with claim 2 wherein the actuator comprises a fluid operated cylinder comprising a spring and operated by fluid pressure in one direction to actuate the one of the blades past the other of the blades and actuated in another direction opposite the one direction by the force of a spring.

4. The apparatus in accordance with claim I and further comprising a photodetector disposed between the printer roller and the label cutter apparatus and generating a detector output signal and wherein the controller is responsive to the detector output signal to selective activate the printer roller to move the strip of linerless label material along the path.

5. The apparatus in accordance with claim 2 and further comprising an air pressure tube disposed adjacent the printer roller and on one side of the cutter apparatus and on the adhesive side of the strip of linerless material and extending transverse to the path, the tube comprising a plurality of orifices opening toward the path for directing streams of air toward the path and to apply a force to the adhesive side of the strip in a direction away from the printer roller.

6. The apparatus in accordance with claim 5 and further comprising an additional air pressure tube extending transverse to the path disposed on the adhesive side of the strip of linerless material and on an opposite side of the cutter apparatus, the additional air pressure tube comprising a plurality of orifices opening toward the path for directing streams of air toward the adhesive side of the strip adjacent the opposite side of the cutter apparatus and to apply a force to a portion of the strip adjacent the opposite side of the cutting apparatus and in a direction away from the vertically extending cutting plate.

7. Apparatus for producing printed labels from linerless label material comprising:

a predefined path and a strip of linerless label material extending along the predefined path, the strip of linerless material having a predefined width and having an adhesive side coated with an adhesive and a non-adhesive side;

a print head disposed along the path and on the non-adhesive side of the strip of the linerless label material;

label cutter apparatus disposed along the path and spaced apart from the print head and having one side adjacent the print head and an opposite side;

a printer roller disposed adjacent the print head and on the adhesive side of the strip of linerless label material for engaging the adhesive side of the strip, the printer roller operative to advance the strip from the roll of linerless label material and along the print head and to the cutter apparatus;

an upper plate disposed adjacent the printer roller on the adhesive side of the strip of linerless material and in alignment with the print head for guiding the strip in the direction of the print head, the upper plate comprising opposing end walls extending perpendicular to the path and having end surfaces, and an inner spatial area extending between the opposing end walls, the end surfaces of the opposing end walls providing contact areas for engaging the adhesive surface of the strip of linerless label material, whereby the upper plate provides a reduced area of contact with the adhesive side of the linerless label strip while guiding the strip into a position to be printed by the print head on the non-adhesive side of the strip.

8. The apparatus in accordance with claim 7 and further comprising a roll of linerless label material, the strip of linerless label material extending from the roll, and a guide disposed between the roll and the print head, the guide comprising a lower wall extending in a plane substantially parallel to the path and opposing side walls extending in a direction perpendicular to the plane, the side walls spaced apart by a distance greater than the predefined width.

9. The apparatus in accordance with claim 7, and further comprising an air pressure tube disposed adjacent the printer roller and on the adhesive side of the strip of linerless material and extending transverse to the path, the tube comprising a plurality of orifices opening toward the path for directing streams of air toward the path and to apply a force to the strip in a direction away from the the printer roller.

10. The apparatus in accordance with claim 9 wherein the air pressure tube is disposed on one side of the cutter apparatus and further comprising an additional air pressure tube extending transverse to the path and disposed on the adhesive side of the strip of linerless material and on the opposite side of the cutter apparatus and having a plurality of orifices opening toward the path for directing streams of air toward the path and to apply a force to the strip in a direction away from the additional air pressure tube.

11. A method of producing printed labels from a strip of linerless label material comprising the steps of:

positioning a first selected area of a strip of linerless label material adjacent a print head;

printing the first selected area by operation of the print head;

advancing the strip by a predetermined distance to position a second selected area adjacent the print head;

printing the second selected area by operation of the print head;

advancing the strip to position the first selected area adjacent a label applicator;

cutting the first selected area from the strip adjacent the label applicator;

withdrawing the strip to position the second selected area between the label applicator and the print head and to position a third selected area adjacent the print head;

printing the third selected area;

advancing the strip to position the second selected area adjacent the label applicator and cutting the second selected area from the strip adjacent the label applicator;

withdrawing the strip to position the third selected area between the label applicator and the print head and to position a fourth selected area adjacent the print head; and printing the fourth selected area.

12. The method in accordance with claim 11 and further comprising the step of detecting the position of a leading edge of the strip adjacent the print head and positioning the leading edge at a predetermined position relative to the print head before the step of positioning the first selected portion of the strip adjacent the print head.

* * * * *